US005725485A

United States Patent [19]

Ribando et al.

[11] Patent Number: 5,725,485

[45] Date of Patent: Mar. 10, 1998

[54] CONNECTOR FOR A GRADIENT SEQUENTIAL COMPRESSION SYSTEM

[75] Inventors: Philip P. Ribando; Kenneth M. Bolam; Donald H. Peeler, all of Charlotte, N.C.; Terry L. Sandman, Toledo, Ohio

[73] Assignee: Beiersdorff Jobst, Inc., Charlotte, N.C.

[21] Appl. No.: 673,622

[22] Filed: Jun. 26, 1996

Related U.S. Application Data

[63] Continuation of Ser. No. 222,829, Apr. 5, 1994, Pat. No. 5,588,954.

[51] Int. Cl.[6] ..... A61H 7/00

[52] U.S. Cl. ..... 601/152; 601/150; 601/151

[58] Field of Search ..... 601/148–152

[56] References Cited

U.S. PATENT DOCUMENTS

| | | | |
|---|---|---|---|
| 3,133,777 | 5/1964 | Anhalt . | |
| 3,288,132 | 11/1966 | Meredith . | |
| 3,409,859 | 11/1968 | Krehbiel . | |
| 3,467,081 | 9/1969 | Glass . | |
| 3,811,431 | 5/1974 | Apstein . | |
| 3,862,629 | 1/1975 | Rotta . | |
| 3,885,554 | 5/1975 | Rockwell, Jr. . | |
| 3,942,518 | 3/1976 | Tenteris et al. . | |
| 3,944,261 | 3/1976 | Reed . | |
| 4,013,069 | 3/1977 | Hasty . | |
| 4,029,087 | 6/1977 | Dye et al. . | |
| 4,030,488 | 6/1977 | Hasty . | |
| 4,043,015 | 8/1977 | Hickman . | |
| 4,150,673 | 4/1979 | Watt . | |
| 4,156,425 | 5/1979 | Arkans . | |
| 4,198,961 | 4/1980 | Arkans . | |
| 4,202,325 | 5/1980 | Villari et al. . | |
| 4,207,875 | 6/1980 | Arkans . | |
| 4,207,876 | 6/1980 | Annis . | |
| 4,253,449 | 3/1981 | Arkans et al. | 601/152 |
| 4,280,485 | 7/1981 | Arkans . | |

(List continued on next page.)

FOREIGN PATENT DOCUMENTS 0 392 669 10/1990 European Pat. Off. .

OTHER PUBLICATIONS

Kendall Healthcare Products Company brochure entitled "*A Clinically Proven Home Regimen to Treat Venous Insufficiency*" (1989).

Kendall Healthcare Products Company Instruction Manual entitled "*SCD™ Therapeutic System*," pp. 1–8 (1989).

Kendall Healthcare Products Company Sep. 1, 1993 letter and brochure entitled "*T.E.D. ®/SCD™ Compression System*".

Kendall Healthcare Products Company brochure entitled "*Making Prevention Operative*," (1991).

(List continued on next page.)

*Primary Examiner*—Robert A. Hafer
*Assistant Examiner*—Benjamin K. Koo
*Attorney, Agent, or Firm*—The Bell Seltzer Intellectual Property Group of Alston & Bird LLP

[57] ABSTRACT

A fluid connector for a compression system for improving venous blood flow in a patient provides a continuous fluid passageway between a source of pressurized fluid and a plurality of inflatable chambers in an elongated pressure sleeve. The connector includes a flexible conduit comprising a plurality of elongate hollow tubes having a corresponding plurality of fittings attached at one end of the conduit. The fittings form a fluid-tight seal between the conduit and a corresponding plurality of outlet ports communicating with the source of pressurized fluid. A grip portion is provided adjacent the end of the conduit. The grip portion is releasably attached to the source of pressurized fluid and grips the conduit securely between adjacent tubes such that the fittings move freely and independently relative to the grip portion. In this manner, leakage of the pressurized fluid and contamination of the fluid stream is minimized, while stresses induced in the conduit are not transferred to the fittings. At its other end, the conduit may include couplers for forming a fluid-tight seal with sleeve fittings attached to the inflatable chambers of the pressure sleeve.

22 Claims, 4 Drawing Sheets

U.S. PATENT DOCUMENTS

| | | | |
|---|---|---|---|
| 4,311,135 | 1/1982 | Brueckner et al. . | |
| 4,320,746 | 3/1982 | Arkans et al. . | |
| 4,321,929 | 3/1982 | Lemelson et al. . | |
| 4,331,133 | 5/1982 | Arkans . | |
| 4,335,726 | 6/1982 | Kolstedt . | |
| 4,338,944 | 7/1982 | Arkans . | |
| 4,372,297 | 2/1983 | Perlin . | |
| 4,375,217 | 3/1983 | Arkans . | |
| 4,396,010 | 8/1983 | Arkans . | |
| 4,408,599 | 10/1983 | Mummert . | |
| 4,413,620 | 11/1983 | Tucker . | |
| 4,481,937 | 11/1984 | Arkans . | |
| 4,574,812 | 3/1986 | Arkans . | |
| 4,577,626 | 3/1986 | Marukawa et al. . | |
| 4,583,522 | 4/1986 | Aronne . | |
| 4,702,232 | 10/1987 | Gardner et al. . | |
| 4,762,121 | 8/1988 | Shienfeld . | |
| 4,793,328 | 12/1988 | Kolstedt et al. . | |
| 4,804,208 | 2/1989 | Dye . | |
| 4,841,956 | 6/1989 | Gardner et al. . | |
| 4,858,596 | 8/1989 | Kolstedt et al. . | |
| 4,922,893 | 5/1990 | Wright et al. . | |
| 5,007,411 | 4/1991 | Dye . | |
| 5,022,387 | 6/1991 | Hasty . | |
| 5,031,604 | 7/1991 | Dye . | |
| 5,117,812 | 6/1992 | McWhorter . | |
| 5,179,941 | 1/1993 | Siemssen et al. . | |
| 5,186,163 | 2/1993 | Dye . | |
| 5,193,052 | 3/1993 | Larson . | |
| 5,219,185 | 6/1993 | Oddenino | 285/26 |
| 5,234,185 | 8/1993 | Hoffman . | |
| 5,263,473 | 11/1993 | McWhorter . | |
| 5,588,954 | 12/1996 | Ribando et al. | 601/149 |

OTHER PUBLICATIONS

Kendall Healthcare Products Company information order form entitled "*A Clinically Proven Home Regimen to Treat Venous Insufficiency,*" (1989).

Kendall Healthcare Products Company brochure entitled "*The Home Rx™ Vascular Compression System for Healing Venous Ulcers,*" (1991).

Kendall T.E.D.® Sequential Compression Device Model 5320 Operating Instructions, pp. 1–17, 1985.

Olson et al., "*Experimental Studies of External Pneumatic Compression Methods on a Model Human Leg,*" 32nd ACEMB, Denver Hilton Hotel, Denver, CO, Oct. 6–10, 1979.

Salzman, et al., "Effect of Optimization of Hemodynamics on Fibrinolytic Activity and Antithrombotic Efficacy of External Pneumatic Calf Compression," Annals of Surgery, vol. 206, No. 5, Nov. 1987, pp. 636–641.

Caprini, "*Role of Compression Modalities in a Prophylactic Program for Deep Vein Thrombosis,*" Seminars in Thrombosis and Hemostasis–Supplement, vol. 14, 1988, pp. 77–87.

Hull, et et al., "*Effectiveness of Intermittent Pneumatic Leg Compression for Preventing Deep Vein Thrombosis After Total Hip Replacement,*" JAMA, vol. 263, No. 17, May 2, 1990, pp. 2313–2317.

Bucci, et al., "*Mechanical Prophylaxis of Venous Thrombosis in Patients Undergoing Craniotomy: A Randomized Trial,*" Surg. Neurol. vol. 32, 1989, pp. 285–288.

Jobst brochure entitled, "*Athrombic Pump®–System 2000–Intermittent Compression Device*".

Jobst 510(k) Notice dated Sep. 25, 1989. Exhibits 1A–6G are attached as follows:.

*Exhibit 1A:* photographs of front and rear view of Sytem 2000; *Exhibit 1B:* photograph of System 2000 with wrap–around pneumatic sleeve and photograph of wrap–around pneumatic sleeve; *Exhibit 1C:* photograph of System 2000 with disposable wrap–around pneumatic sleeve and photograph of disposable wrap–around pneumatic sleeve.

*Exhibit 2A:* instructions for operation of Athrombic Pump® System 2000; *Exhibit 2B:* instructions for operation of Jobst Athrombic Pump System Wrap–Around Pneumatic Sleeve; *Exhibit 2C:* instructions for operation of Jobst Athrombic Pump System Disposable Wrap–Around Pneumatic Sleeve; *Exhibit 2D:* instructions for operation of Athrombic Pump® Model 116620, Form 586R6; *Exhibit 2E:* instructions for operation of Jobst® Extremity Pump®, Model 116600, Form 582.

*Exhibit 3A:* front panel label (artwork)–condensed instructions for Jobst Athrombic Pump® System 2000; *Exhibit 3B:* data plate label; *Exhibit 3C:* front and back view of Wrap–Around Sleeve label; *Exhibit 3D:* front and back view of Disposable Wrap–Around Sleeve label; *Exhibit 3E:* description of Air Chamber label.

*Exhibit 4A:* Jobst brochure entitled, "*Venous Thrombosis in the High–Risk Patient*", Form 945 (1987); *Exhibit 4B:* Jobst article entitled: *Deep Vein Thrombosis,* Form 294R3 (1981); *Exhibit 4C:* Jobst brochure entitled, *Anti–Em® Anti–Embolism Extremity Pump™,* Form 639 (1974).

*Exhibit 5A:* Kendall advertisement; *Exhibit 5B:* Kendall advertisement for T.E.D./SEC Compression System; *Exhibit 5C:* Kendall Model 5320 operating instructions –T.E.D.® Sequential Compression Device; *Exhibit 5D:* Baxter advertisement for Pulsatile Anti–Embolism System; *Exhibit 5E:* Gaymar Industries, Inc. advertisement for Thrombogard; *Exhibit 5F:* Lyne–Nicholson, Inc. advertisement for Venodyne; *Exhibit 5G:* Camp International Inc. advertisement for Hemaflo; *Exhibit 5H:* Comparative Chart–Compression Systems for Treatment of D.V.T.

*Exhibit 6A:* Salzman, et al.,"*Intraoperative external pneumatic calf compression to afford long–term prophylaxis against deep vein thrombosis in urological patients,*" Surgery, vol. 87, No. 3, 1980, pp. 239–242.

*Exhibit 6B:* "*Prevention of Venous Thrombosis and Pulmonary Embolism,*"National Institutes of Health Consensus Development Conference Statement, vol. 6, No. 2.

*Exhibit 6C:* Hull et al., "*Effectiveness of Intermittent Pulsatile Elastic Stockings for the Prevention of Calf and Thigh Vein Thrombosis in Patients Undergoing Elective Knee Surgery*" (undated); *Exhibit 6D:* Coe et al., *Prevention of deep vein thrombosis in urological patients: A controlled, randomized trial of low–dose heparin and external pneumatic compression boots,* Surgery, vol. 83, No. 2, 1978, pp. 230–234, *Exhibit 6E:* Klein et al., *Prevention of Thromboembolism in Urological Patients* (undated); *Exhibit 6F:* Whalen et al., *Deep Vein Thrombosis–Prophylaxis* (undated); *Exhibit 6G:* Salzman et al., *Effect of Optimization of Hemodynamics on Fibrinolytic Activity and Antithrombotic Efficacy of External Pneumtic Calf Compression,* Ann. Surg., vol. 206, No. 5, 1987, pp. 636–641.

Letter to Food and Drug Administration dated Dec. 20, 1989 supplementing 510(k).

Letter to Food and Drug Administration dated Nov. 9, 1989 supplementing 510(k). Exhibits 1–5D are attached as follows:.

*Exhibit 1:* Jobst Institute, Inc. Overview of Deep Vein Thrombosis, Pulmonary Embolism and Discussion of Prophylactic Methods.

*Exhibit 2:* Jobst Nov. 8, 1989 Memorandum to File from Kotwick Regarding: Evolution of the Design of the Jobst Athrombic Pump.

*Exhibit 3A:* Jobst Institute, Inc., Engineering Study #89102, Introduction & Methods, Title: Electromagnetic Interference Considerations of the Jobst Athrombic Pump System 2000. *Exhibit 3B:* Jobst Institute, Inc., Engineering Study #89102, Results & Discussion.

*Exhibit 4A:* Jobst Institute, Inc., Engineering Study #89101, Introduction & Methods, Title: Performance Comparison of the Jobst Athrombic Pumps. *Exhibit 4B:* Jobst Institute, Inc., Engineering Study #89101, Results & Discussion.

*Exhibit 5A:* Graor et al., "*The Comparative Evaluation of Deep Vein Thrombosis Prophylaxis in Total Joint Replacement Patents: An Interim Report,*" presented at the 1989 meeting of the American Academy of Orthopaedic Surgeons. *Exhibit 5B:* Salzman et al., *Prevention of Venous Thromboembolism in Unstable Angina Pectoris,* The New England Journal of Medicine, vol. 306, No. 16, 1982. *Exhibit 5C:* Moser, *Pulmonary thromboembolism: Your challenge is prevention,* The Journal of Respiratory Diseases, vol. 10, No. 10, 1989, pp. 83–85, 88, 91–93. *Exhibit 5D:* Green et al., *Deep Vein Thrombosis in Spinal Cord Injury: Effect Prophylaxis with Calf Compression, Aspirin, and Dipyridamole,* Paraplegia, vol. 20, 1982, pp. 227–234.

CONNECTOR FOR A GRADIENT SEQUENTIAL COMPRESSION SYSTEM

CROSS-REFERENCE TO RELATED APPLICATIONS

This application is a continuation of application Ser. No. 08/222,829, filed Apr. 5, 1994, now U.S. Pat. No. 5,588,954.

This application is related to application Ser. No. 08/223,429, entitled GRADIENT SEQUENTIAL COMPRESSION SYSTEM AND METHOD FOR IMPROVING VENOUS BLOOD FLOW (Attorney Docket No. 8316-3), now U.S. Pat. No. 5,575,762, and application Ser. No 08/222,407, now abandoned, entitled COMPRESSION SLEEVE FOR USE WITH A GRADIENT SEQUENTIAL COMPRESSION SYSTEM (Attorney Docket No. 8316-8) filed concurrently herewith, the disclosures of which are incorporated by reference.

BACKGROUND OF THE INVENTION

1. Field of the invention

The present invention relates to therapeutic medical devices for improving venous blood flow in a patient. More particularly, the invention relates to a connector for providing a continuous fluid passageway between a source of pressurized fluid and a compression sleeve.

2. Description of the Prior Art

Therapeutic medical devices are known for reducing the occurrence of deep vein thrombosis (DVT) and pulmonary embolism in recumbent users. Such devices operate by applying pressure to the limb of a patient. The applied pressure prevents pooling of the blood in the limb by forcing the venous blood to return to the heart. Typically, the devices include a controller for regulating a source of pressurized fluid, such as air, and a compression sleeve which communicates with the controller through a fluid connector. The compression sleeve is placed around the limb of the patient and the controller regulates inflation and venting of the compression sleeve. The connector provides a continuous fluid passageway between the source of pressurized fluid and the compression sleeve.

Prior art connectors for compression systems are subject to leaking pressurized fluid at the joints between the connector and the controller, and at the joints between the connector and the compression sleeve. For many reasons, it is desirable for the connector to be quickly and easily removable, particularly at the interface between the controller and the connector. Rapid and repeated connections, however, increase the likelihood of leakage of the pressurized fluid which reduces the efficiency of the compression system and creates contamination problems. Leakage occurs primarily when the connections are improperly made, when the connecting portions become worn, or when stresses are inadvertently applied to the ends of the connector.

A connector for use with a therapeutic compression system is described in U.S. Pat. No. 4,253,449 to Arkans et al. The connector includes a first connection member which is rigidly secured on each side to retaining flanges on a controller. The first connection member includes a plurality of cylindrical ports with passageways therethrough for communicating with a second connection member. A plurality of tubular sections are retained by the second connection member such that when the second connection member is received between the retaining flanges of the controller, the tubular sections are in abutting relation with the cylindrical ports on the first connection member. O-rings are provided on the outer diameter of the cylindrical ports for forming a seal with the second connection member to prevent leakage of the pressurized fluid from the controller. The connection between the first connection member and the second connection member is accomplished by positioning the second connection member between the retaining flanges and over the O-rings on the outer diameter of the cylindrical ports of the first connection member. Thus, a fluid-tight seal is made only if the dimensional tolerances of the first connection member, the retaining flanges, the second connection member and the tubular sections are tightly controlled. Because the O-rings which seal the interface between the first connection member and the second connection member are on the outer diameter of the ports, leakage can occur at the abutting interface between the ports and the tubular sections if the tubular sections are loosely retained in the second connection member, or are not retained in parallel relationship with the ports.

The connector includes a conduit having a plurality of passageways therethrough which abut the tubular sections retained by the second connection member. At their downstream ends, the plurality of passageways are attached to a corresponding plurality of tubular sections retained in a third connection member. The third connection member acts as a manifold to distribute the pressurized fluid in the conduit into two separate conduits for delivering the pressurized fluid to compression sleeves on each of the patient's legs. Because the manifold separates the connector conduit into two additional conduits, the number of joints through which the pressurized fluid must pass is thereby multiplied. Thus, the potential for leakage of the pressurized fluid or contamination of the fluid stream is greatly increased.

Another problem encountered with prior art fluid connectors for compression systems is that the connector is not easily or rapidly removable from the controller. The connector described in the Arkans et al. patent is not easily grasped and removed. Only a portion of the second connection member extends beyond the retaining flanges on the controller. Thus, it is difficult to firmly grasp the second connection member for aligning, connecting and disconnecting the first connection member and the second connection member. As a result, substantial mechanical stresses and strains are transferred to the tubular sections retained by the second connection member. With repeated use, the joints between the tubular sections and the ports are weakened and the likelihood of leakage of the pressurized fluid or contamination of the fluid stream is greatly increased.

SUMMARY OF THE INVENTION

It is therefore an object of the present invention to provide a fluid connector for a therapeutic compression system which minimizes leakage and contamination of the source of pressurized fluid.

It is another object of the invention to provide a fluid connector which forms a fluid-tight seal with the controller of a compression system.

It is another object of the invention to provide a fluid connector with a grip portion for easily and rapidly connecting and disconnecting the connector from the controller of a compression system.

These and other objects, features and advantages are accomplished by the present invention in which a fluid connector is provided for a system for gradient sequential compression of a patient's limb and acceleration of deep venous blood flow. The compression system associated with the connector provides cyclical squeezing and relaxing action to one or more limbs of a patient. The system includes a controller having a pneumatic compressor, compression sleeves, and a fluid connector for supplying air to inflatable chambers within the compression sleeves. Each compression sleeve encircles a limb of a patient and the deep venous blood in the patient's limb is accelerated by sequentially establishing a decreasing gradient of compressive forces along the limb in a proximal direction.

In particular, the compression system includes one or more sleeves (e.g., calf, thigh, calf and thigh, etc.) which can be wrapped around and releasably secured to a limb of a patient. The sleeves have one or more inflatable chambers for retaining pressurized fluid, preferably air, upon inflation and for applying a compressive force to a limb. The compression system also includes a system controller for controlling transfers of pressurized air to the inflatable chambers of the compression sleeves during respective inflation cycles, and for venting the pressurized air during respective deflation cycles. Transfers of air from the system controller to the sleeves is preferably provided by a fluid connector which includes a conduit removably attached to the controller on one end, and to the inflatable chambers on the other end.

The connector provides a continuous fluid passageway between the source of pressurized fluid and the compression sleeves. The connector includes a flexible conduit which is preferably made of a soft, formable plastic, such as polyvinyl chloride (PVC), and comprises at least one elongate hollow tube. In a preferred embodiment, the conduit comprises a plurality of tubes in spaced relation joined together between adjacent pairs of tubes by a partition having cross-sectional dimensions much less than the diameter of the tubes.

At one end, the conduit forms a fluid-tight seal with a plurality of outlet ports from the controller. The conduit is releasably attached to the controller by a plurality of fittings inserted into the ends of the conduit tubes. In operation, the number of fittings corresponds to the number of tubes in the conduit and the number of outlet ports from the controller. Each fitting includes means for forming a fluid-tight seal between the corresponding tube and outlet port to thereby communicate the pressurized fluid from the controller to the inflatable chambers of the compression sleeve.

A grip portion is attached to the conduit adjacent the end of the conduit attached to the controller. The grip portion allows the connector to be easily and rapidly attached to the controller. Once attached, the connection releasably retains the fittings in fluid-tight relationship with the outlet ports. The grip portion is formed in a plurality of body sections, preferably two halves, each having an interior and an exterior surface and first and second ends.

Gripping means extend inwardly from the interior surfaces of the body sections and combine with slots formed in the conduit to secure the conduit to the grip portion. The grip portion is secured to the conduit at the second end of the grip portion farthest from the fittings. By gripping the conduit at the second end of the grip portion, the fittings have the greatest amount of flexibility. Thus, the manufacturing tolerances on the outlet ports, fittings, conduit, and grip portion may be relaxed. The connection between the connector and the controller is therefore made more secure by the independent movement of the fittings relative to the grip portion and the likelihood of leakage of the pressurized fluid and contamination of the fluid stream is thereby greatly reduced.

The grip portion also includes latching means comprising a biased latching member which is integrally formed with each body section. The latching member includes a gripping surface and a latching lip which extends outwardly from the exterior surface of the grip portion and combines with a slot in the controller for releasably securing the grip portion to the controller. In a preferred embodiment, the gripping means engage the partitions through the slots formed in the conduit between adjacent pairs of tubes without substantially compressing the tubes. In this manner, stresses and strains induced in the conduit are not transferred to the fittings at the ends of the tubes. Instead, the stresses and strains are transferred through the latching means of the grip portion to the body of the controller. Thus, wear on the fittings is minimized and the likelihood of leakage of the pressurized fluid or contamination of the fluid stream is greatly reduced.

In an alternative preferred embodiment, flanges are provided on the outer edges of the conduit such that the gripping means engage the slots formed in the flanges (instead of the slots formed in the partitions of the conduit between adjacent pairs of tubes) without substantially compressing the tubes. In the same manner, however, stress and strain relief is provided to the fittings at the ends of the tubes. While the gripping means may take many forms, in preferred embodiments the gripping means comprise fingers extending inwardly from the body sections between adjacent pairs of semi-circular cutouts which loosely retain the tubes in the conduit. The fingers extend into the slots in the conduit (in the partitions between adjacent tubes, or in the flanges at the outer edges of the tubes) to secure the conduit in longitudinal relation with the grip portion.

In another preferred embodiment, the conduit forms a fluid-tight seal at its other end with a plurality of sleeve fittings attached to the chambers of the compression sleeve. The conduit is releasably attached to the compression sleeve by a plurality of couplers which are tightly fitted into the ends of the conduit tubes. In operation, the number of couplers corresponds to the number of tubes in the conduit and the number of sleeve fittings in the inflatable chambers of the compression sleeve. Each coupler includes means for forming a fluid-tight seal between the corresponding tube and the sleeve fitting to thereby communicate the pressurized fluid from the controller to the inflatable chambers of the compression sleeve.

In another preferred embodiment, one of the tubes of the conduit includes orienting means for readily indicating which of the tubes corresponds to the chamber of the compression sleeve which is to receive the greatest pressure. Preferably, the orienting means comprises a raised portion extending outwardly from the outer surface which is visible and has texture such that it will be felt when the conduit is grasped. Thus, the conduit can be rapidly checked to insure proper operation of the compression system.

In another preferred embodiment, at least one of the body sections includes orienting means for permitting the connector to be connected to the source of pressurized fluid in only one predetermined orientation. The orienting means may, for example, comprise a recess in one or more of the exterior surfaces of the body sections. Thus, the connector can be repeatedly attached to the controller such that the pressure in the tubes of the conduit corresponds to the desired gradient in the inflatable chambers of the compression sleeve.

BRIEF DESCRIPTION OF THE DRAWINGS

A more complete understanding of the present invention will be had when the detailed description of the preferred embodiments is considered in conjunction with the accompanying drawings in which.

DETAILED DESCRIPTION OF THE PREFERRED EMBODIMENTS

While the invention will be described in connection with preferred embodiments, it should be recognized and understood that the following description is not intended to limit the invention to the preferred embodiments. On the contrary, the invention is intended to include all alternatives, modifications and equivalents which may be determined to be within the spirit and scope of the invention as disclosed and claimed below.

Figure 1:
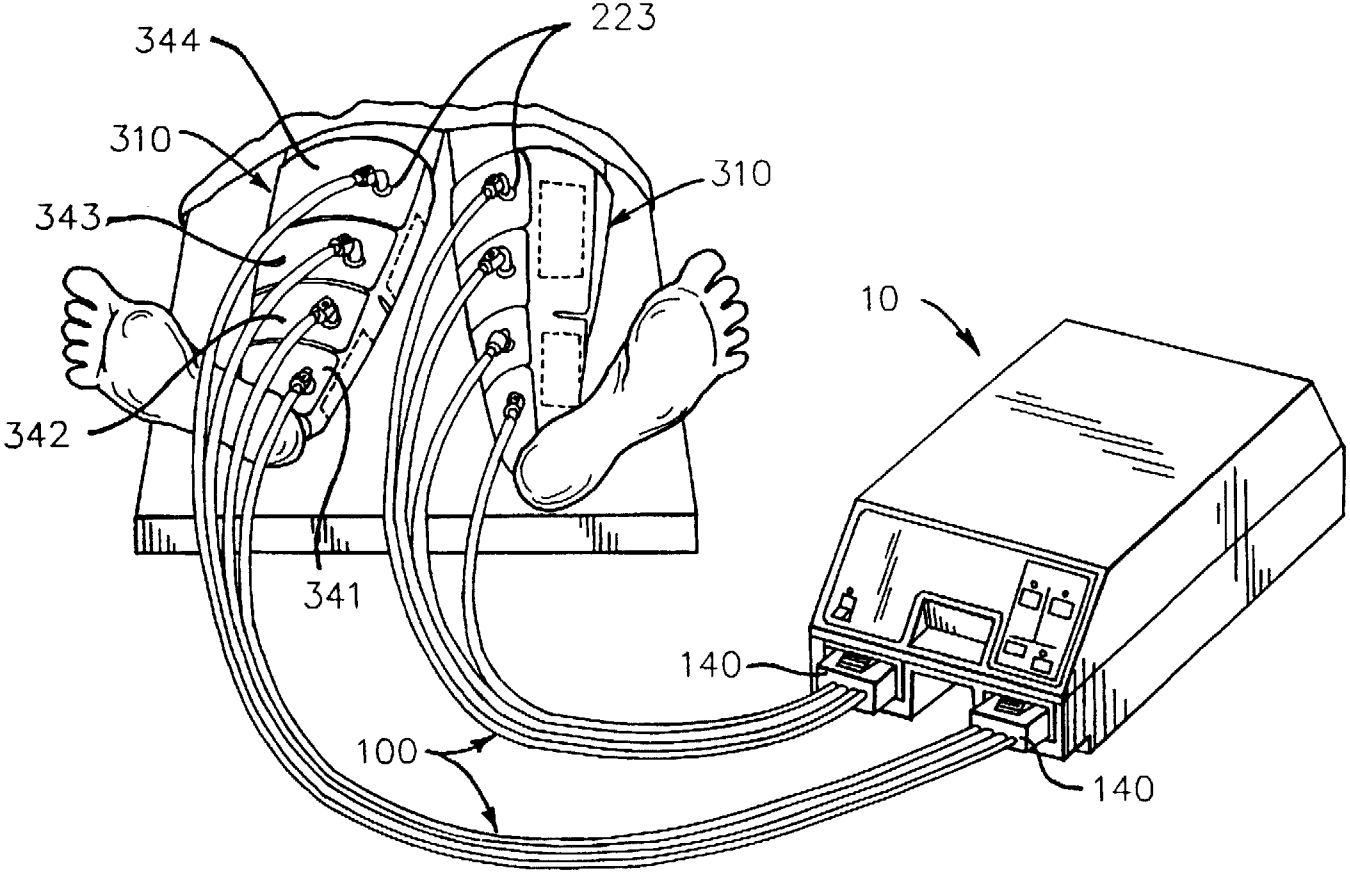
FIG. 1 illustrates a sequential gradient compression system for improving venous blood flow which utilizes the connector of the present invention.

Referring to FIG. 1, a gradient sequential compression system utilizing the connector of the present invention is illustrated. The compression system comprises a controller 10 having a pair of connector interfaces; a pair of compression sleeves 310 having a plurality of inflatable chambers 341, 342, 343, 344 and a plurality of sleeve fittings 223, and a pair of fluid connectors generally indicated at 100. Each connector 100 provides a continuous fluid passageway between the controller 10 and one of the sleeves 310.

Figure 2:
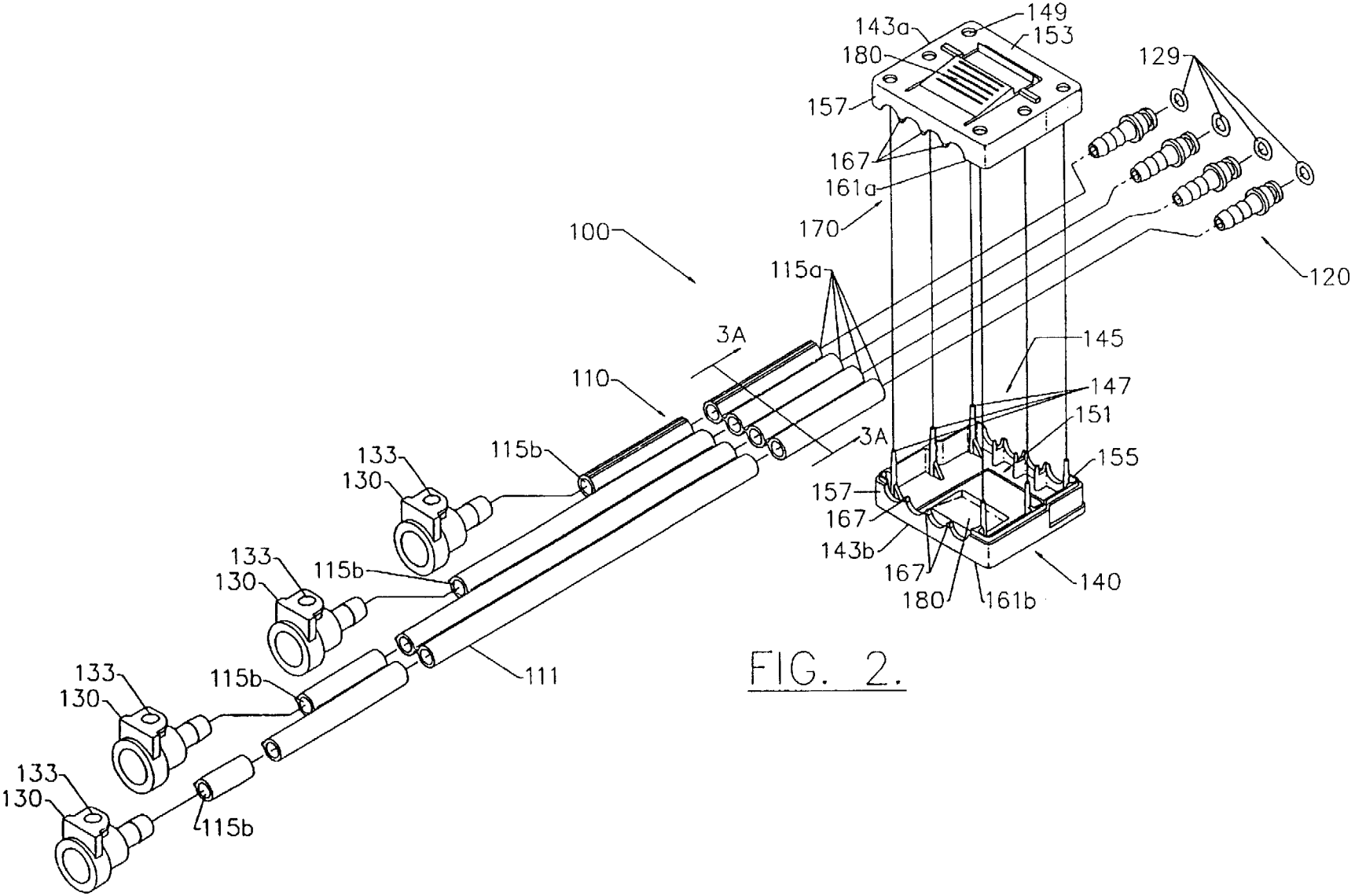
FIG. 2 is an exploded perspective view of the connector portion of the compression system illustrated in FIG. 1.
Figure 4A:
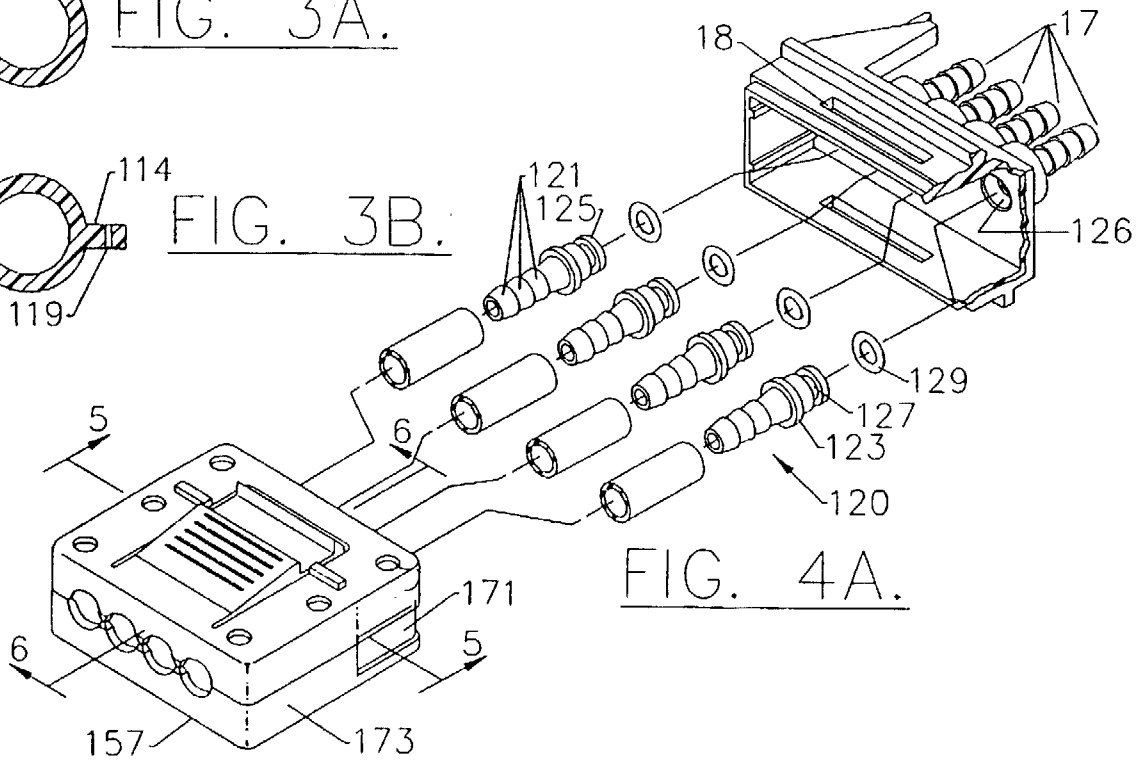
FIG. 4A is an exploded perspective view of the end of the connector of FIG. 2 which is attached to the controller of the compression system illustrated in FIG. 1.

The connector 100 for rapidly connecting and disconnecting the controller 10 and one or more of the inflatable compression sleeves 310 for applying gradient sequential compressive pressures against a patient's limb is shown in FIG. 2. The connector 100 includes a flexible conduit 110, fittings 120, couplers 130 and grip portion 140. In a preferred embodiment (FIG. 1), a connector 100 interacts with each of two connector interfaces in controller 10 having a plurality of outlet ports 17 (FIG. 4A). Each connector 100 thereby interconnects the controller 10 with one of the compression sleeves 310.

Flexible conduit 110 comprises a plurality of integrally formed elongate hollow tubes 111 in spaced relation. The flexibility of the conduit 110 allows a user to select a position for the controller 10 which is both comfortable for the patient and accessible to the operator, while conforming to the space available for operation of the compression system.

In a preferred embodiment, the conduit 110 is made of soft plastic, such as polyvinyl chloride (PVC), and comprises four thin-walled tubes 111 of generally circular cross-section having a first end **115*a* and a second end 115*b*. Tubes 111 define pneumatic passageways for interconnecting each outlet port 17 of the controller 10 to a respective sleeve fitting 223 for each chamber 341, 342, 343, 344 of sleeve 310**.

Figure 3A:
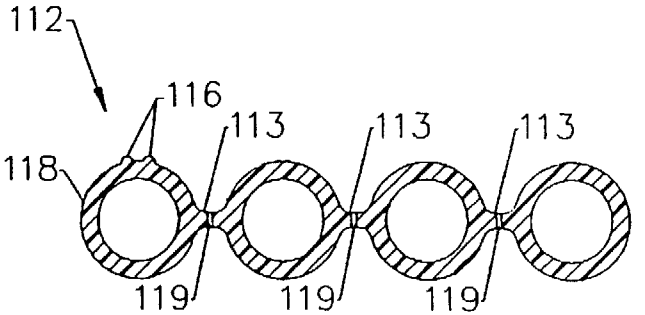
FIG. 3A is a sectional view of the connector of FIG. 2 taken along line 3A—3A.

As shown most clearly in FIG. 3A, tubes 111 in conduit 110 are spaced by elongate partitions 113 positioned between adjacent tubes. Partitions 113 retain tubes 111 in fixed spatial relation to one another for communicating with grip portion 140 in a manner to be described hereafter. Partitions 113 are generally rectangular in cross-section and are substantially smaller in dimensions than the inside diameter of tubes 111. In a preferred embodiment, one of the tubes 111 of the conduit 110 includes orienting means 112 for readily indicating which of the tubes corresponds to the chamber 341, 342, 343, 344 of the compression sleeve 310 which is to receive the greatest pressure. Preferably, the orienting means 112 comprises raised portions 116 on the exterior surface 118 of the tube 111 extending radially outwardly from the exterior surface. Raised portions 116 are visible and have texture such that they will be felt when conduit 110 is grasped. Thus, conduit 110 can be readily checked to insure proper operation of the compression system.

At a first end **115*a*, conduit 110 includes a plurality of hollow, generally cylindrical fittings 120. The number of fittings 120 corresponds to the number of tubes 111 in conduit 110. Fittings 120 may be secured to the ends 115*a* of tubes 111 by any suitable means, but are preferably press fit. The ends 115*a* of tubes 111 are resilient and fittings 120 include a plurality of circumferential barbs 121 (FIG. 4A) extending longitudinally along the length of the fitting such that when the fitting is press fit, it is not easily removed from the tube. A radially extending rib 123 acts as a mechanical stop for positioning fittings 120 so that when the ends 115*a* of tubes 111 are generally coplanar, fittings 120 will extend substantially equal distances outwardly from first ends 115*a* of conduit 110. Fittings 120 include nipple portions 125 for communicating with corresponding receiving holes 126 in outlet ports 17 of controller 10. Reduced diameter portions 127 on fittings 120 are provided for receiving O-rings 129. O-rings 129 form a tight seal with receiving holes 126 in outlet ports 17 to prevent the pressurized air from escaping at the connections between fittings 120 and outlet ports 17**.

Figure 4B:
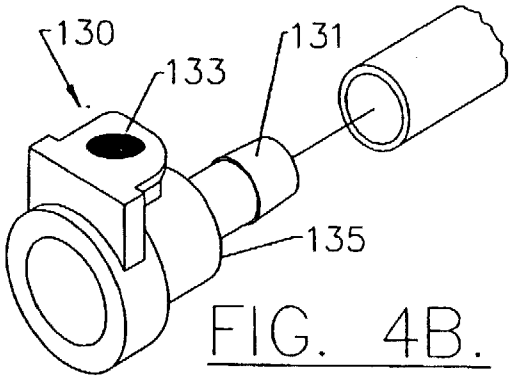
FIG. 4B is an exploded perspective view of the end of the connector of FIG. 2 which is attached to the compression sleeve of the compression system illustrated in FIG. 1.

As shown most clearly in FIG. 4B, at its second end **115*b*, connector 100 includes a plurality of longitudinally-spaced sequential quick-release couplers 130. Couplers 130 may be of the type described in U.S. Pat. No. 5,052,725 and do not form a part of the present invention. The number of couplers 130 corresponds to the number of tubes 111 in conduit 110. Couplers 130 are secured to tubes 111 at second end 115*b* by any suitable means such that couplers 130 are not easily removed from tubes 111. In a preferred embodiment, a circumferential, radially extending connecting barb 131 on coupler 130 is oversized in relation to the inside diameter of tube 111. The temperature of the end 115*b* of tube 111 is raised to soften the plastic material of the tube to permit connecting barb 131 to be inserted into the end of the tube. Upon cooling, the resilient plastic material reshapes to conform to the profile of coupler 130 so that the pressurized air will not escape from the connection between coupler 130 and tube 111**.

Each of tubes 111 has a predetermined length such that couplers 130 are spaced-apart at longitudinal positions which accommodate the locations of the chambers 341, 342, 343, 344 in sleeve 310. In a preferred embodiment (shown in FIG. 2), conduit 110 is divided at second end **115*b* into four separate longitudinally-spaced ends which are secured to four couplers 130 corresponding to each of the four tubes 111. In operation, couplers 130 are releasably attached to corresponding sleeve fittings 223 in chambers 341, 342, 343, 344 to define pneumatic passageways for interconnecting controller 10 and sleeve 310. Each coupler 130 includes printed indicia 133 on the body 135 of the coupler which corresponds to like printed indicia on sleeve fittings 223 in chambers 341, 342, 343, 344. Thus, when couplers 130 are properly connected to corresponding sleeve fittings 223 in chambers 341, 342, 343, 344 a continuous pneumatic passageway is formed for interconnecting controller 10 and sleeve 310 to accomplish the objectives of the compression system. In one embodiment, printed indicia 133 and the like indicia on sleeve fittings 223 are predetermined colors such that couplers 130 and sleeve fittings 223 in chambers 341, 342, 343, 344 are color-coded. An alternative embodiment may have the entire coupler and sleeve fitting 223** color coded.

Figure 5:
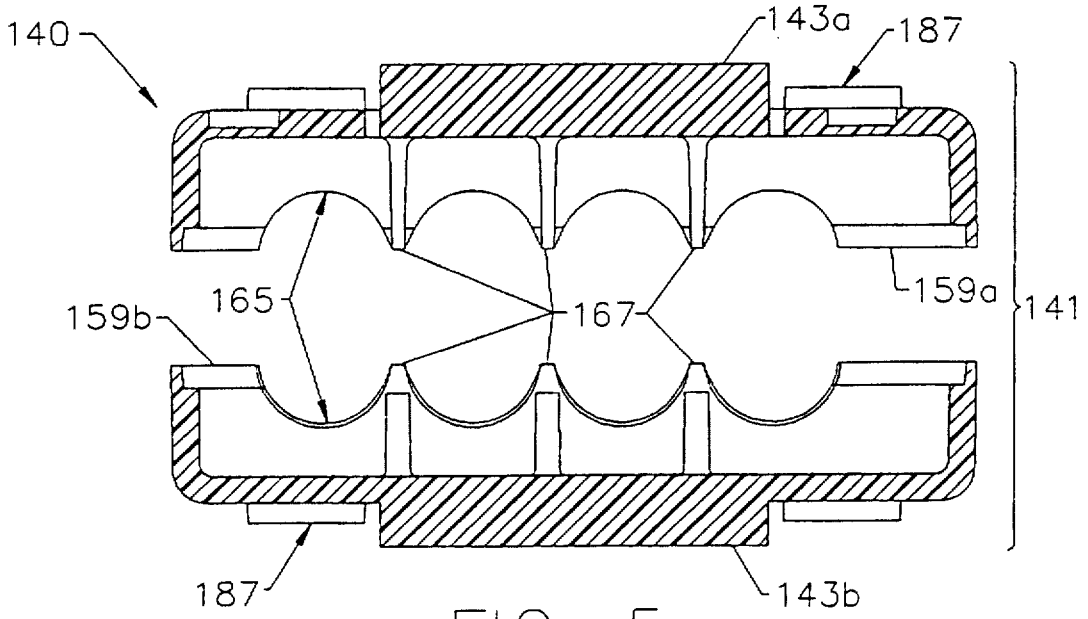
FIG. 5 is an exploded transverse sectional view of the grip portion of FIG. 4A taken along line 5—5.
Figure 6:
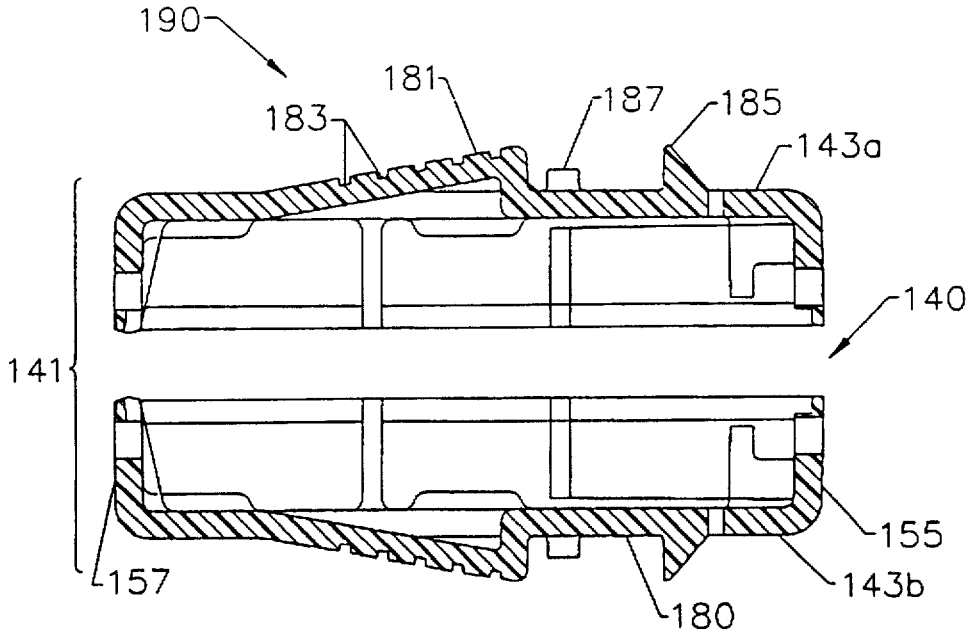
FIG. 6 is an exploded longitudinal sectional view of the grip portion of FIG. 4B taken along line 6—6.

A grip portion 140, shown also in FIGS. 5 and 6, is positioned adjacent first end 115*a* of the conduit 110 for aligning fittings 120 with outlet ports 17 of controller 10. Grip portion 140 includes a housing 141 formed by top body section 143*a* and bottom body section 143*b*. Body sections 143*a* and 143*b* are preferably molded of a suitable plastic, but may be formed by any means which accomplish the objectives of the invention described hereafter. Top body section 143*a* and bottom body section 143*b* are joined together by fastener means 145 (FIG. 2) to form housing 141. In a preferred embodiment, fastener means 145 secures body sections 143*a* and 143*b* together such that once the sections are joined to form housing 141, they grip portion 140 cannot be disassembled. For example, fastener means 145 may comprise plastic posts 147 in bottom body section 143*b* which interact with holes 149 in top body section 143*a*. Posts 147 are then fused to plastic material surrounding holes 149 such that the posts integrally connect bottom body section 143*b* to top body section 143*a*. Alternatively, the two body sections may be sealed together along the edges where they meet.

Body sections 143*a* and 143*b* include interior surface 151, exterior surface 153, first end 155 and second end 157. Body sections 143*a* and 143*b* further comprise first vertical walls 159*a*, 159*b* extending inwardly at first end 155, and second vertical walls 161*a*, 161*b* extending inwardly at second end 157. First and second vertical walls 159*a*, 159*b*, 161*a*, 161*b* include a plurality of spaced semi-circular cutouts 165. The number of cutouts 165 in each vertical wall corresponds to the number of tubes 111 in conduit 110. Semi-circular cutouts 165 in first and second vertical walls 159*a*, 161*a* of top body section 143*a*, and semicircular cutouts 165 in first and second vertical walls 159*b*, 161*b* of bottom body section 143*b* interact when the body sections are joined to form a plurality of circular cutouts for receiving mounting tubes 111 of conduit 110. Vertical walls 159*a*, 159*b*, 161*a*, 161*b* further include a plurality of inwardly extending fingers 167 positioned between adjacent cutouts 165. The number of fingers 167 in each vertical wall corresponds to the number of partitions 113 in conduit 110. Fingers 167 in first and second vertical walls 159*a*, 161*a* of top body section 143*a*, and fingers 167 in first and second vertical walls 159*b*, 161*b* of bottom body section 143*b* interact when the body sections are joined to form gripping means 170 for gripping partitions 113 of conduit 110. The circular cutouts thereby formed in housing 141 of grip portion 140 loosely encircle tubes 111 such that grip portion 140 surrounds conduit 110 without contacting fittings 120. The pneumatic passageways thereby provide a continuous passageway for permitting the pressurized air from the controller 10 to flow into the chambers 341, 342, 343, 344 in sleeve 310 to inflate the chambers in the desired sequence without directly contacting grip portion 140. At the same time, gripping means 170 grip partitions 113 at second end 157 such that stresses induced by tension in or movement of the conduit 110 are transferred to grip portion 140 instead of directly to fittings 120.

Figure 3B:
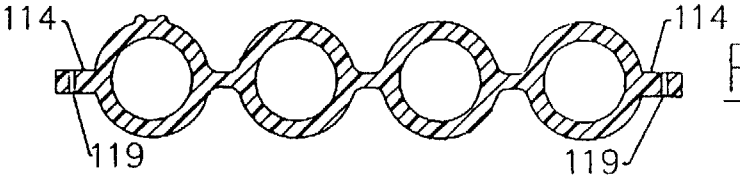
FIG. 3B is a sectional view of an alternative embodiment of the connector of FIG. 2 taken along a line corresponding to 3A—3A.

In a preferred embodiment, conduit 110 is provided with holes 119 (shown in FIGS. 3A and 3B) for interacting with fingers 167 in second vertical walls 161*a*, 161*b* at second end 157. In this manner, the transfer of stresses from conduit 110 to grip portion 140 is enhanced. In another preferred embodiment, conduit 110 comprises flanges 114. Fingers 167 in second vertical walls 161*a*, 161*b* engage holes 119 in conduit 110 adjacent second end 157 of grip portion 140. In the same manner as described above, the transfer of stresses from conduit 110 to grip portion 140 is enhanced. Also, in both preferred embodiments, fingers 167 in first vertical walls 159*a*, 159*b* include overlapping sections 169 for completely sealing grip portion 140 at first end 155.

As shown most clearly in FIG. 4A, body sections 143*a* and 143*b* include recesses 171 in exterior surfaces 153 of side walls 173. In a preferred embodiment, however, at least one of side walls 173, and preferably only one, does not include a recess 171. In this manner, grip portion 140 is keyed to the connector interface in controller 10 so that connector 100 can be inserted into the connector interface in controller 10 in only one predetermined orientation. Thus, the continuous pneumatic passageways interconnecting controller 10 and sleeve 310 will inflate chambers 341, 342, 343, 344 in the desired sequence.

As shown most clearly in FIGS. 4A, 5 and 6, body sections 143*a* and 143*b* include latching members 180 having inclined gripping surfaces 181 on exterior surfaces 153. Latching members 180 are formed integrally, for example by molding, with body sections 143*a* and 143*b* such that the latching members are biased about a resilient joint formed along an axis perpendicular to the direction in which conduit 110 passes through grip portion 140. Latching members 180 are thereby inwardly and outwardly movable in relation to body sections 143*a* and 143*b*. Each inclined gripping surface 181 comprises a series of transverse grooves 183 which provide texture to gripping surface 181 for enabling a user to securely grasp grip portion 140 when disconnecting and connecting connector 100 from controller 10. Latching members 180 include latching lips 185 which interact with slots 18 (FIG. 4A) in the connector interface in controller 10 for securing grip portion 140, and thus conduit 110, to controller 10. The interaction between latching lips 185 and slots 18 formed thereby provides further transfer of the stresses induced in conduit 110 through grip portion 140 to controller 10. Mechanical stops 187 are provided on exterior surfaces 153 for preventing grip portion 140 from being forced into the connector interface in controller 10 further than necessary to make proper connection between fittings 120 and outlet ports 17. In this manner, a latching means 190 is provided which comprises pivotally mounted latching member 180, latching lip 185 and slot 18 in the connector interface in controller 10. The conduit 110 is secured to controller 10 at first end 115*a* by first squeezing latching members 180 together at gripping surfaces 181, then inserting grip portion 140 into the controller interface in controller 10 until latching lips 185 interact with slots 18 and mechanical stops 187 engage the connector interface, then releasing the latching members so that the latching lips engage slots 18 in the connector interface.

Obviously, many alternative configurations and modifications of the present invention are within the ordinary skill of those trained in the art. It is to be understood that the present invention is not intended to be limited to the preceding description of the preferred embodiments, but rather is intended to encompass all embodiments within the spirit and scope of the invention disclosed and claimed herein.

That which is claimed:

1. A compression system for applying gradient sequential compression to a limb of a patient and accelerating deep venous blood flow in the limb from a source of pressurized fluid, comprising:

an elongated pressure sleeve surrounding at least a portion of the limb, the sleeve defining a plurality of inflatable chambers each having a means for attachment to the source of pressurized fluid;

an inflating means for inflating said chambers, said inflating means having a connector interface comprising at least one outlet port;

a connector for providing a continuous fluid passageway between the source of pressurized fluid and said chambers, said connector comprising:

a flexible plastic conduit having a first end and a second end, wherein said conduit comprises a plurality of elongate tubes integrally formed in spaced relation, each of said tubes having an exterior surface and an interior surface;

at least one fitting attached to said first end of said conduit and forming a fluid-tight seal therewith, said fitting having means for forming a fluid-tight seal with said outlet port to communicate the pressurized fluid;

a grip portion attached to said first end of said conduit and gripping said conduit to guide said fitting while permitting independent movement of said fitting, said grip portion releasably retaining said fitting in fluid-tight relationship with said outlet port; and at least one coupler attached to said second end of said conduit, wherein the number of said fittings and the number of said couplers is the same as the number of said tubes, and wherein each of said fittings is attached to one of said tubes at said first end and each of said couplers is attached to one of said tubes at said second end.

2. The compression system according to claim 1 wherein at least one of said tubes comprises a raised portion on said exterior surface of said tube extending longitudinally a sufficient length of said tube to serve as an indicator of the position of said tube relative to said connector interface.

3. The compression system according to claim 1 wherein the number of said fittings and the number of said couplers is the same as the number of said tubes, and wherein each of said fittings is attached to one of said tubes at said first end and each of said couplers is attached to one of said tubes at said second end.

4. The compression system according to claim 3 wherein each of said plurality of tubes has a length adapted to match the positions of said chambers and said couplers are sequentially spaced at said second ends of said tubes to correspond to the positions of said chambers.

5. The compression system according to claim 3 wherein each of said couplers comprises indicia corresponding to indicia on said chambers.

6. The compression system according to claim 1 wherein said conduit comprises integrally formed elongate connecting partitions between adjacent pairs of said tubes.

7. The compression system according to claim 6 wherein said grip portion engages said partitions without substantially compressing said tubes.

8. The compression system according to claim 1 wherein said conduit comprises integrally formed elongate flanges at the outer edges of said conduit.

9. The compression system according to claim 8 wherein said grip portion engages said flanges without substantially compressing said tubes.

10. A connector for providing a continuous fluid passageway between a source of pressurized fluid and an elongated pressure sleeve, said sleeve defining a plurality of inflatable chambers, each having a means for attachment to the source of pressurized fluid at a connector interface having at least one outlet port, said connector comprising:

a flexible plastic conduit comprising at least one elongate tube, said tube having a first end and a second end;

at least one fitting attached to said first end of said conduit and forming a fluid-tight seal therewith, said fitting having means for forming a fluid-tight seal with said outlet port to communicate the pressurized fluid; and a grip portion attached adjacent said first end of said conduit and gripping said conduit to guide said fitting while permitting independent movement of said fitting, said grip portion releasably retaining said fitting in fluid-tight relationship with said outlet port, wherein the number of said fittings is the same as the number of said tubes, and wherein each of said fittings is attached to one of said tubes at said first end.

11. The connector according to claim 10 wherein the number of said fittings is the same as the number of said tubes, and wherein each of said fittings is attached to one of said tubes at said first end.

12. The connector according to claim 10 wherein said conduit comprises integrally formed elongate connecting partitions between adjacent pairs of said tubes.

13. The connector according to claim 12 wherein said grip portion engages said partitions without substantially compressing said tubes.

14. The connector according to claim 10 wherein said conduit comprises integrally formed elongate flanges at the outer edges of said conduit.

15. The connector according to claim 14 wherein said grip portion engages said flanges without substantially compressing said tubes.

16. The connector according to claim 10 wherein said grip portion comprises a plurality of body sections, each of said body sections having an interior and an exterior surface and a first end and a second end, and wherein said grip portion comprises gripping means extending outwardly from said interior surfaces of said body sections for securing said conduit to said grip portion.

17. The connector according to claim 16 wherein said body sections comprise cutouts in said first end and said second end for receiving said tubes between said body sections.

18. The connector according to claim 10 wherein said grip portion comprises latching means comprising at least one biased latching member integrally formed with one of said body sections, said latching member comprising a gripping surface and a latching lip extending outwardly from said exterior surface which interacts with the connector interface of the source of pressurized fluid for releasably securing said grip portion thereto.

19. The connector according to claim 16 wherein said exterior surface of at least one of said body sections comprises orienting means for permitting the connector to be connected to the source of pressurized fluid in only one predetermined orientation.

20. The connector according to claim 19 wherein said orienting means comprises a recess in said exterior surface of said body section.

21. The connector according to claim 12 wherein said grip portion engages said partitions and transfers stresses induced in said conduit to said grip portion and provides strain relief to said fittings.

22. The connector according to claim 10 wherein said plastic is polyvinyl chloride.

* * * * *